US012031308B2

(12) United States Patent
Fujimoto et al.

(10) Patent No.: US 12,031,308 B2
(45) Date of Patent: Jul. 9, 2024

(54) FAUCET APPARATUS

(71) Applicant: TOTO LTD., Kitakyushu (JP)

(72) Inventors: Masaya Fujimoto, Kitakyushu (JP); Toshiyuki Murahashi, Kitakyushu (JP)

(73) Assignee: Toto Ltd., Fukuoka (JP)

( * ) Notice: Subject to any disclaimer, the term of this patent is extended or adjusted under 35 U.S.C. 154(b) by 0 days.

(21) Appl. No.: 17/685,482

(22) Filed: Mar. 3, 2022

(65) Prior Publication Data

US 2022/0282464 A1 Sep. 8, 2022

(30) Foreign Application Priority Data

Mar. 5, 2021 (JP) ..... 2021-035257

(51) Int. Cl.
*E03C 1/05* (2006.01)
*E03C 1/08* (2006.01)

(52) U.S. Cl.
CPC ..... *E03C 1/055* (2013.01); *E03C 1/08* (2013.01)

(58) Field of Classification Search
None
See application file for complete search history.

(56) References Cited

U.S. PATENT DOCUMENTS 9,650,769 B2 * 5/2017 Peel ..... F16K 11/24
11,442,479 B2 * 9/2022 Tzeng ..... G05D 23/1927

FOREIGN PATENT DOCUMENTS

JP 2016-141957 A 8/2016
JP 2016141957 A * 8/2016

* cited by examiner

*Primary Examiner* — Nelson J Nieves
*Assistant Examiner* — Meraj A Shaikh
(74) *Attorney, Agent, or Firm* — BakerHostetler

(57) ABSTRACT

A faucet apparatus which is capable of, even when a first spouting mode is adapted to be executed when a detection sensor detects an object, causing function water that has an antibacterial effect or bacteria removing effect to be spouted to a detected object without causing tap water by the first spouting mode to be spouted, so that the antibacterial effect or bacteria removing effect can be caused to effectively work on the object. A controller of the faucet apparatus of the present disclosure comprises the first spouting mode and a second spouting mode, and the controller is further provided with a second spouting mode prioritization function of, even if the detection sensor is into a detection state, performing control not to execute the first spouting mode while the second water mode is executed.

4 Claims, 8 Drawing Sheets

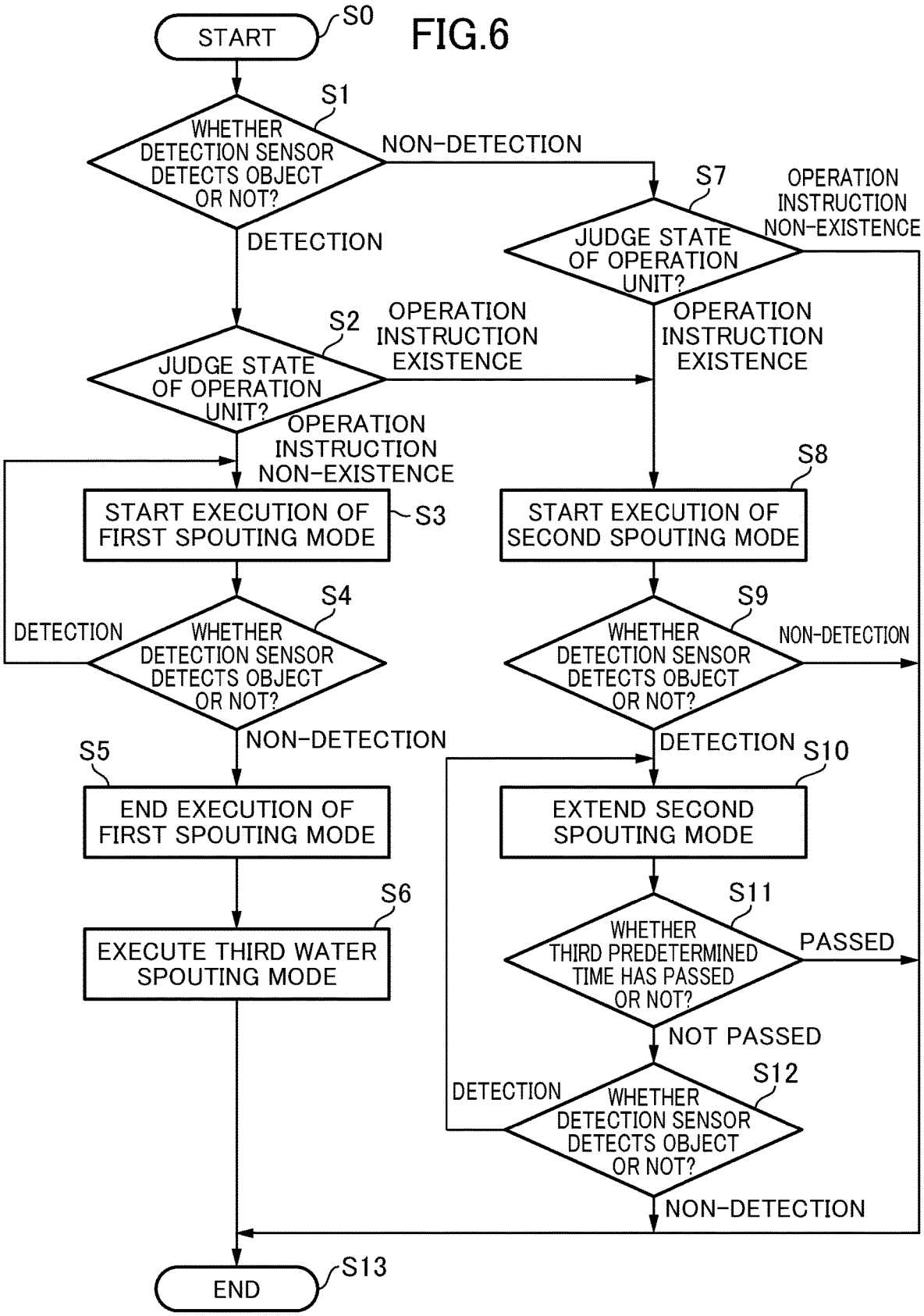
FIG.6
START
S0
S1
WHETHER DETECTION SENSOR DETECTS OBJECT OR NOT?
NON-DETECTION
DETECTION
S7
JUDGE STATE OF OPERATION UNIT?
OPERATION INSTRUCTION NON-EXISTENCE
OPERATION INSTRUCTION EXISTENCE
S2
JUDGE STATE OF OPERATION UNIT?
OPERATION INSTRUCTION EXISTENCE
OPERATION INSTRUCTION NON-EXISTENCE
S8
START EXECUTION OF FIRST SPOUTING MODE
S3
START EXECUTION OF SECOND SPOUTING MODE
S4
DETECTION
WHETHER DETECTION SENSOR DETECTS OBJECT OR NOT?
S9
WHETHER DETECTION SENSOR DETECTS OBJECT OR NOT?
NON-DETECTION
NON-DETECTION
DETECTION
S5
END EXECUTION OF FIRST SPOUTING MODE
S10
EXTEND SECOND SPOUTING MODE
S6
EXECUTE THIRD WATER SPOUTING MODE
S11
WHETHER THIRD PREDETERMINED TIME HAS PASSED OR NOT?
PASSED
NOT PASSED
S12
DETECTION
WHETHER DETECTION SENSOR DETECTS OBJECT OR NOT?
NON-DETECTION
END
S13

FAUCET APPARATUS

CROSS-REFERENCE TO RELATED APPLICATIONS

This application claims benefit of and priority to Japanese Patent Application No. 2021-035257, filed Mar. 5, 2021, the entire content of which is incorporated herein by reference.

FIELD OF THE INVENTION

The present disclosure relates to a faucet apparatus and in particular to a faucet apparatus for spouting supplied tap water into a water receiver.

BACKGROUND OF THE INVENTION

Conventionally, an automatic faucet apparatus has been known which, after a user uses the faucet apparatus by causing tap water to be spouted from a first spouting unit, causes electrolyzed water to be automatically spouted from a second spouting unit to keep a hand washer clean as described in Patent Literature 1 (Japanese Patent Laid-Open No. 2016-141957). In this automatic faucet apparatus, when a mode to be executed when sensor is in a detection state is assumed to be a first spouting mode, the first spouting mode, which is for causing tap water to be spouted from the first spouting unit, is executed when the sensor is into the detection state.

However, the conventional automatic faucet apparatus described above has a problem that, though having a function of capable of causing the first spouting mode for causing tap water to be spouted from the first spouting unit to be executed when the sensor is in the detection state, the automatic faucet apparatus cannot have a function of causing electrolyzed water to be spouted from the second spouting unit into a detection range of the detection sensor while controlling the first spouting mode not to be executed. Therefore, there is a problem that it is not possible to spout only function water to an object, for example, a toothbrush, a glass or the like to cause the antibacterial effect or bacteria removing effect of the function water to sufficiently work on the object.

Therefore, the present disclosure has been made to solve the conventional technical problem and subjects that have been recently requested, and an object is to provide a faucet apparatus capable of, even when the first spouting mode is adapted to be executed when the detection sensor detects an object, causing the function water that has the antibacterial effect or bacteria removing effect to be spouted to a detected object without causing the tap water by the first spouting mode to be spouted, so that it is possible to cause the antibacterial effect or bacteria removing effect to effectively work on the object.

SUMMARY OF THE INVENTION

In order solve the above problem, one embodiment of the present disclosure is a faucet apparatus for spouting supplied tap water into a water receiver, the faucet apparatus including: a tap water spouting portion causing the tap water to be spouted; a function water spouting portion causing function water having a higher bacteria removing effect than the supplied tap water to be spouted; a first solenoid valve switching between an opened state and a closed state of a supply flow path of tap water to the tap water spouting portion; a second solenoid valve switching between an opened state and a closed state of a supply flow path of function water to the function water spouting portion; a controller controlling the first solenoid valve and the second solenoid valve; a detection sensor detecting an object; and an operation portion accepting an operation instruction by a user; wherein the function water spouting portion is formed to spout the function water into a main detection range of the detection sensor; the controller includes: a first spouting mode of, when it is judged that the detection sensor has detected an object, causing the first solenoid valve to be into the opened state and causing the tap water to be spouted from the tap water spouting portion; and a second spouting mode of, by the operation portion accepting the operation instruction, causing the opened state of the second solenoid valve to be continued for a first predetermined time from the opened state which the second solenoid valve become, and causing the function water to be spouted from the function water spouting portion; and the controller further includes a second spouting mode prioritization function, while the second spouting mode is executed, controlling not to execute the first spouting mode even if it is judged that the detection sensor has detected an object. In the one embodiment of the present disclosure configured as described above, the function water spouting portion is formed to spout the function water into the main detection range of the detection sensor; and, the controller comprises the first spouting mode, when the detection sensor has detected an object, causing the first solenoid valve to be into the opened state and causing the tap water to be spouted from the tap water spouting portion and the second spouting mode, by the operation portion accepting the operation instruction, causing the opened state of the second solenoid valve to be continued for the first predetermined time after the second solenoid valve is caused to be into the opened state, and causing the function water to be spouted from the function water spouting portion, the controller further comprises the second spouting mode prioritization function, while the second spouting mode is executed, controlling not to execute the first spouting mode even if the detection sensor has detected an object. Thereby, even if it is judged that the detection sensor has detected an object while the second spouting mode is executed, spouting of the tap water by the first spouting mode is not performed, and the function water spouting portion can spout the function water into the main detection range of the detection sensor. Thus, in comparison with a case where the tap water is simultaneously spouted together with the function water, it is possible to spout only the function water to the object detected by the detection sensor. Thereby, it is possible to, even when the first spouting mode is adapted to be executed when the detection sensor detects an object, cause the function water that has the antibacterial effect or bacteria removing effect to be spouted to a detected object without causing the tap water by the first spouting mode to be spouted, so that it is possible to cause the antibacterial effect or bacteria removing effect to effectively work on the object.

In the one embodiment of the present disclosure, preferably, the first predetermined time in the second spouting mode of the controller is set in advance; and, if, the controller judges that the detection sensor has detected an object and, furthermore, continues the judgment that the detection sensor has detected the object even after the first predetermined time passes while the second spouting mode is executed, the second spouting mode of the controller is extended and executed for more than the first predetermined time while the judgment that the detection sensor has detected the object continues. In the one embodiment of the present disclosure configured as described above, if the controller judges that the detection sensor has detected an object and, furthermore, continues the judgment that the detection sensor has detected the object even after the first predetermined time passes while the second spouting mode is executed, the second spouting mode of the controller is extended and executed for more than the first predetermined time while the judgment that the detection sensor has detected the object continues. Thereby, in the case of starting removal of bacteria from an object within the main detection range of the detection sensor while the second spouting mode is executed, and being going to remove bacteria from the object in the main detection range even after the predetermined time for the second spouting mode passes, it is possible to extend and execute the second spouting mode for more than the predetermined time, continue the removal of bacteria from the object, continue spouting of the function water to the object, and cause the bacteria removing effect to work on the object as necessary.

In the present disclosure, preferably, the controller includes a third water spouting mode, after the detection sensor changes from a detection state of having detected an object to a non-detection state, causing the function water to be spouted from the function water spouting portion for a second predetermined time; and the controller further includes a third water spouting mode omission function, controlling not to execute the third water spouting mode before returning to a waiting state after the second spouting mode has been executed even after the detection sensor changes from the detection state to the non-detection state. In the one embodiment of the present disclosure configured as described above, the controller includes the third water spouting mode, after the detection sensor changes from the detection state of having detected an object to the non-detection state, causing the function water to be spouted from the function water spouting portion for the second predetermined time. Thereby, it is possible to cause the function water to be spouted from the function water spouting portion after the tap water is spouted and make it easy to remove bacteria from the bowl, a drain port of the bowl and the like with the function water. The controller further includes the third water spouting mode omission function, performing control not to execute the third water spouting mode before returning to the waiting state after the second spouting mode has been executed even after the detection sensor changes from the detection state to the non-detection state. Thereby, it is possible to suppress the function water from being wastefully spouted by executing the third water spouting mode after executing the second spouting mode.

In the present disclosure, preferably, the controller further includes a second spouting mode end function, when a third predetermined time longer than the first predetermined time passes from starting the second spouting mode, causing extension of execution of the second spouting mode to be ended even if the controller continues the judgment that the detection sensor has detected the object. In the one embodiment of the present disclosure configured as described above, when the third predetermined time passes from starting the second spouting mode, the controller causes extension of execution of the second spouting mode to be ended by the second spouting mode end function even if the controller continues the judgment that the detection sensor has detected the object. Thereby, even if the controller continues the judgment that the detection sensor has detected an object, the controller can suppress continuance of spouting of the function water more than necessary beyond the third predetermined time and suppress the function water from being uselessly wasted.

According to the faucet apparatus of the present disclosure, it is possible to, even when the first spouting mode is adapted to be executed when the detection sensor detects an object, cause function water that has an antibacterial effect or bacteria removing effect to be spouted to a detected object without causing tap water by the first spouting mode to be spouted, so that the antibacterial effect or bacteria removing effect can be caused to effectively work on the object.

BRIEF DESCRIPTION OF THE DRAWINGS

FIG. 6 is a flowchart showing a water spouting operation of the faucet apparatus according to the one embodiment of the present disclosure;

DETAILED DESCRIPTION OF THE PREFERRED EMBODIMENT

Figure 1:
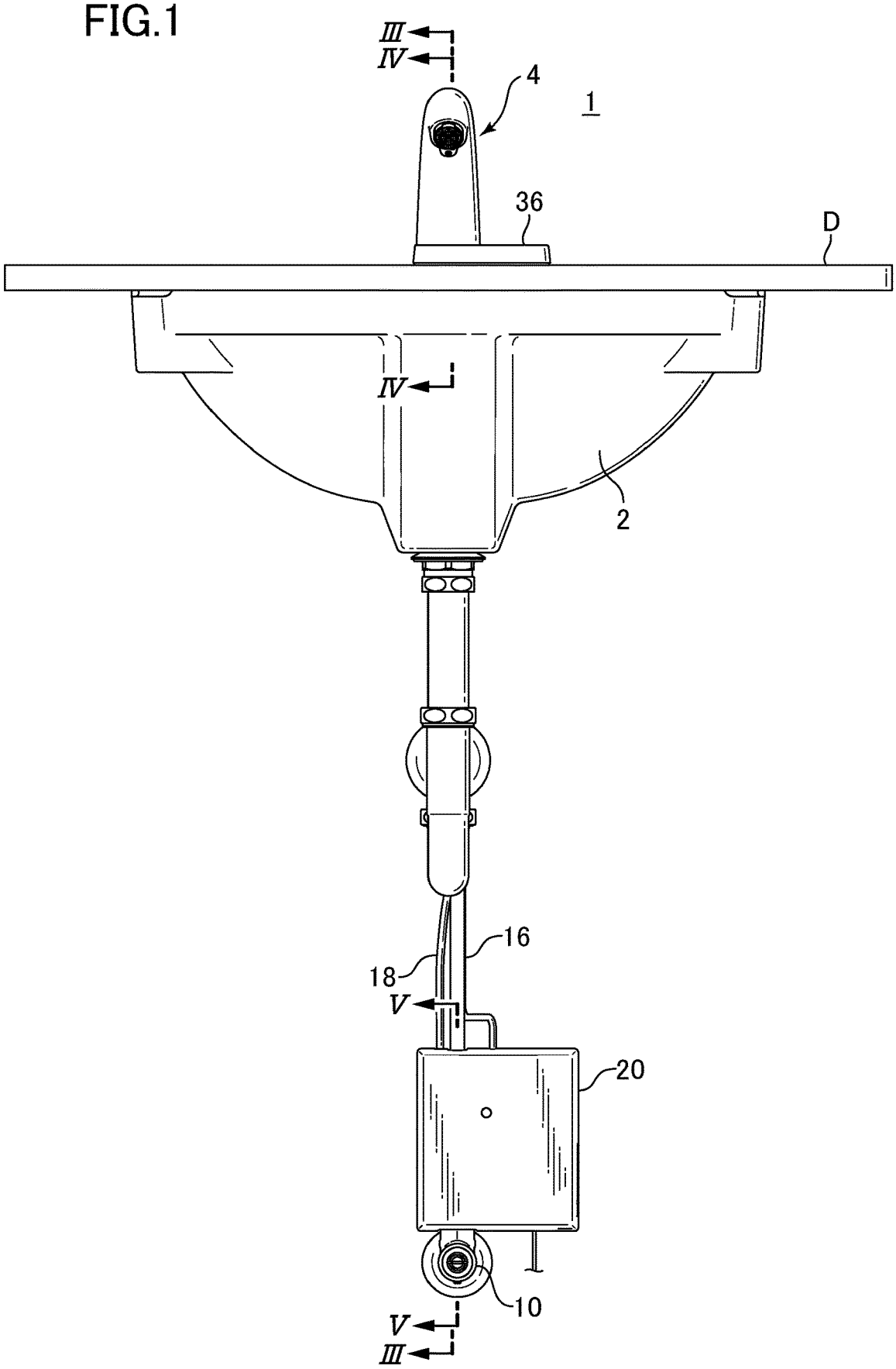
FIG. 1 is a side view of a faucet apparatus according to one embodiment of the present disclosure that is seen from forward.
Figure 2:
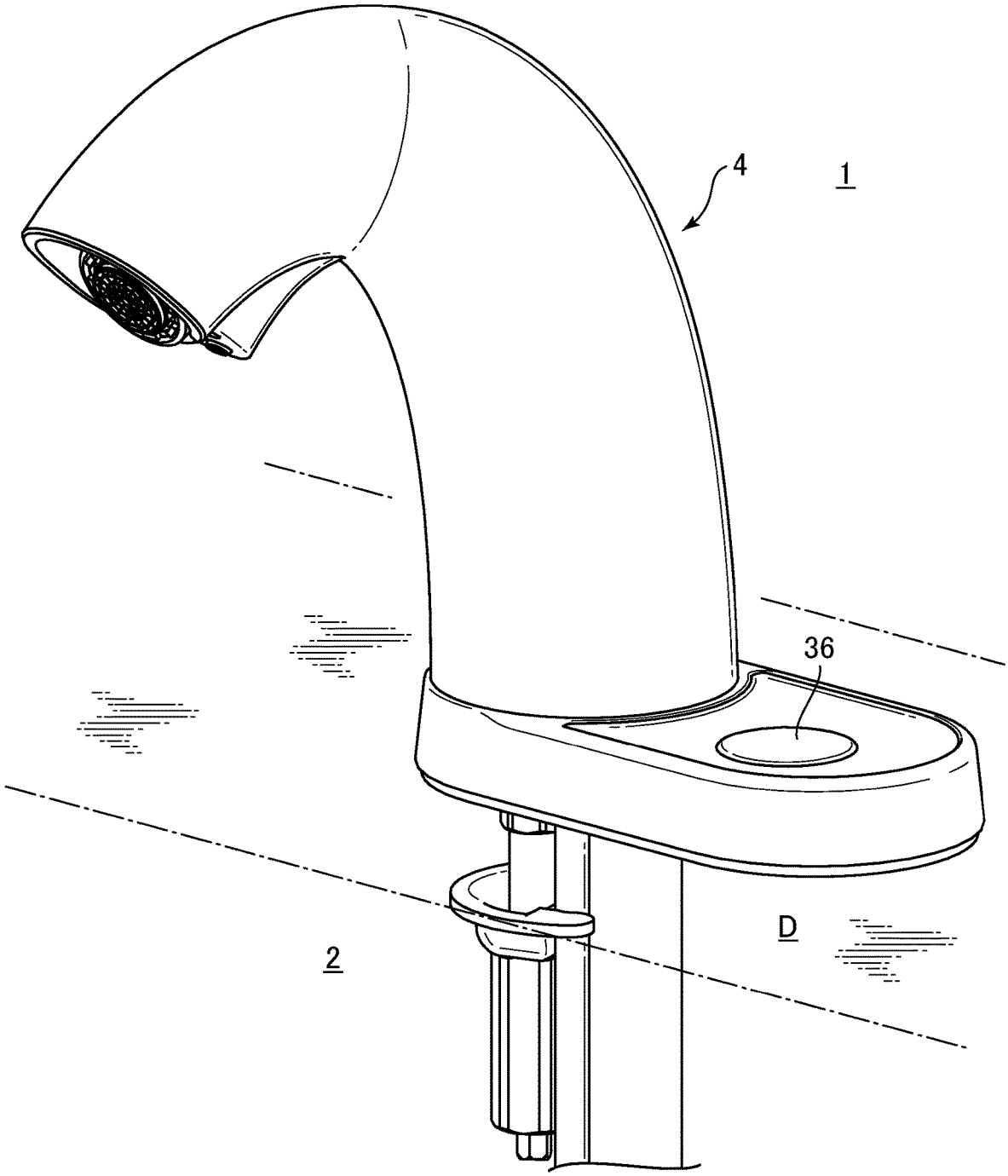
FIG. 2 is a perspective view of a spouting unit on a counter of faucet apparatus according to the one embodiment of the present disclosure.
Figure 3:
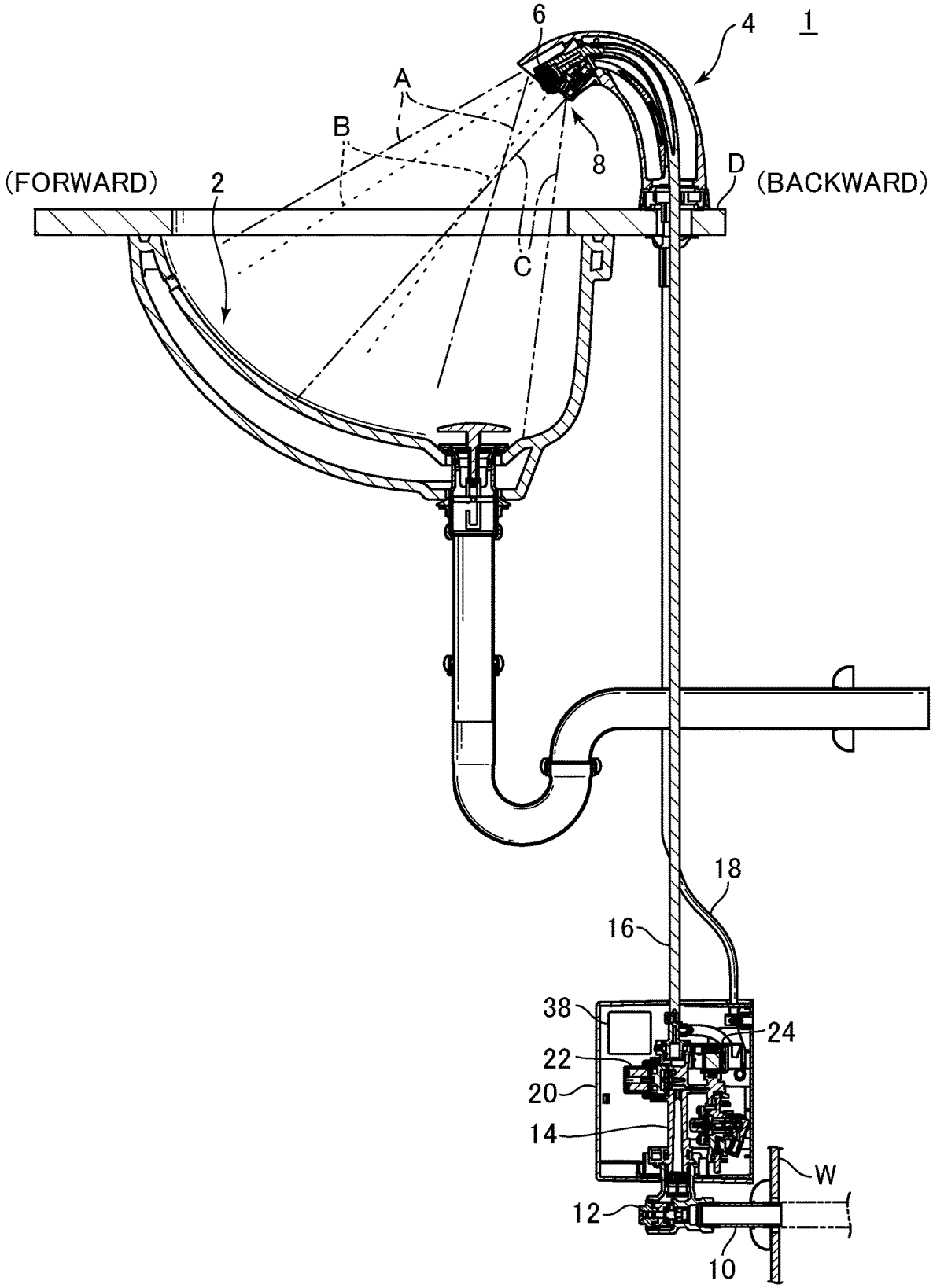
FIG. 3 is a sectional view seen along a line in FIG. 1.
Figure 4:
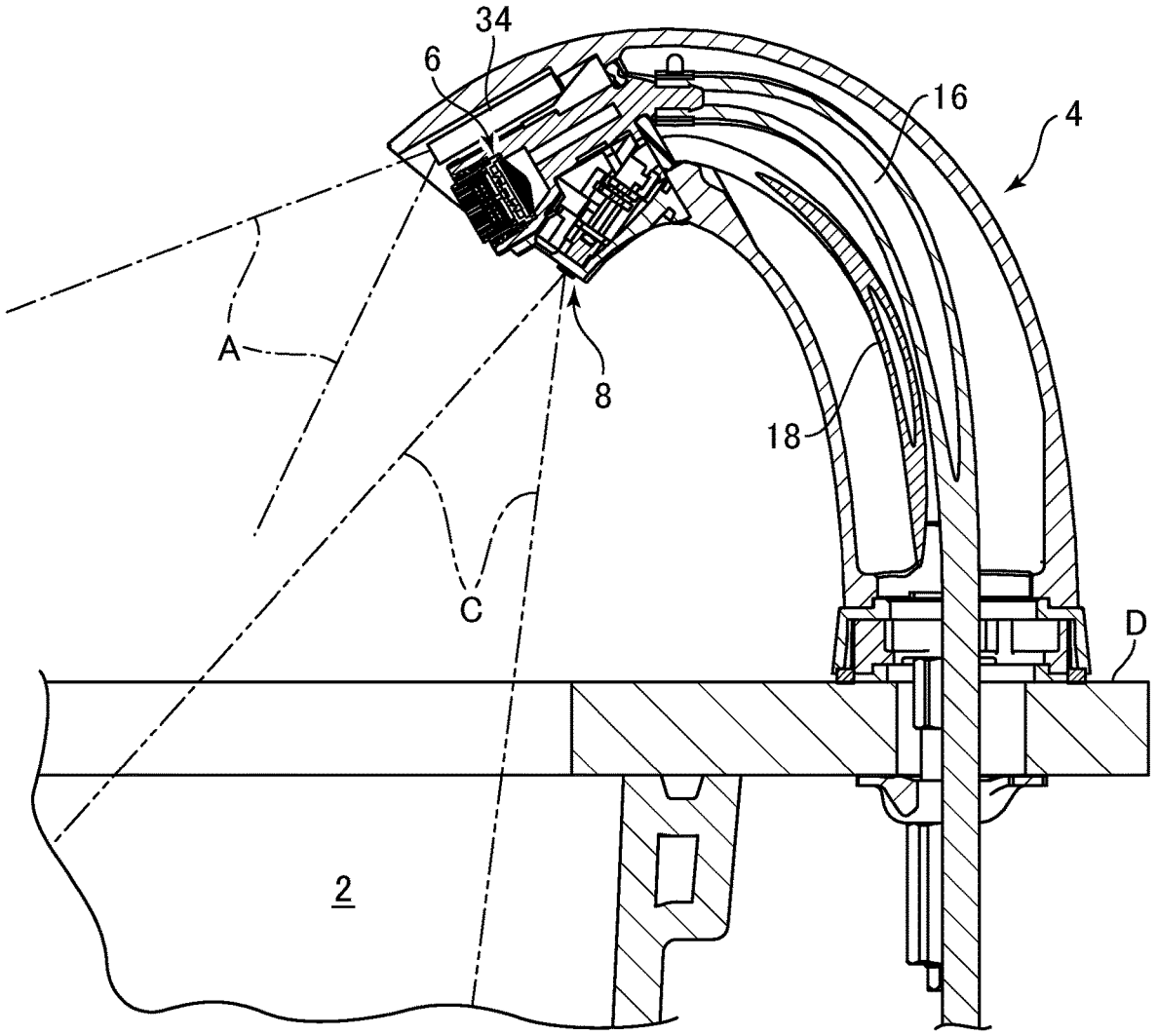
FIG. 4 is a sectional view seen along a IV-IV line in FIG. 1.
Figure 5:
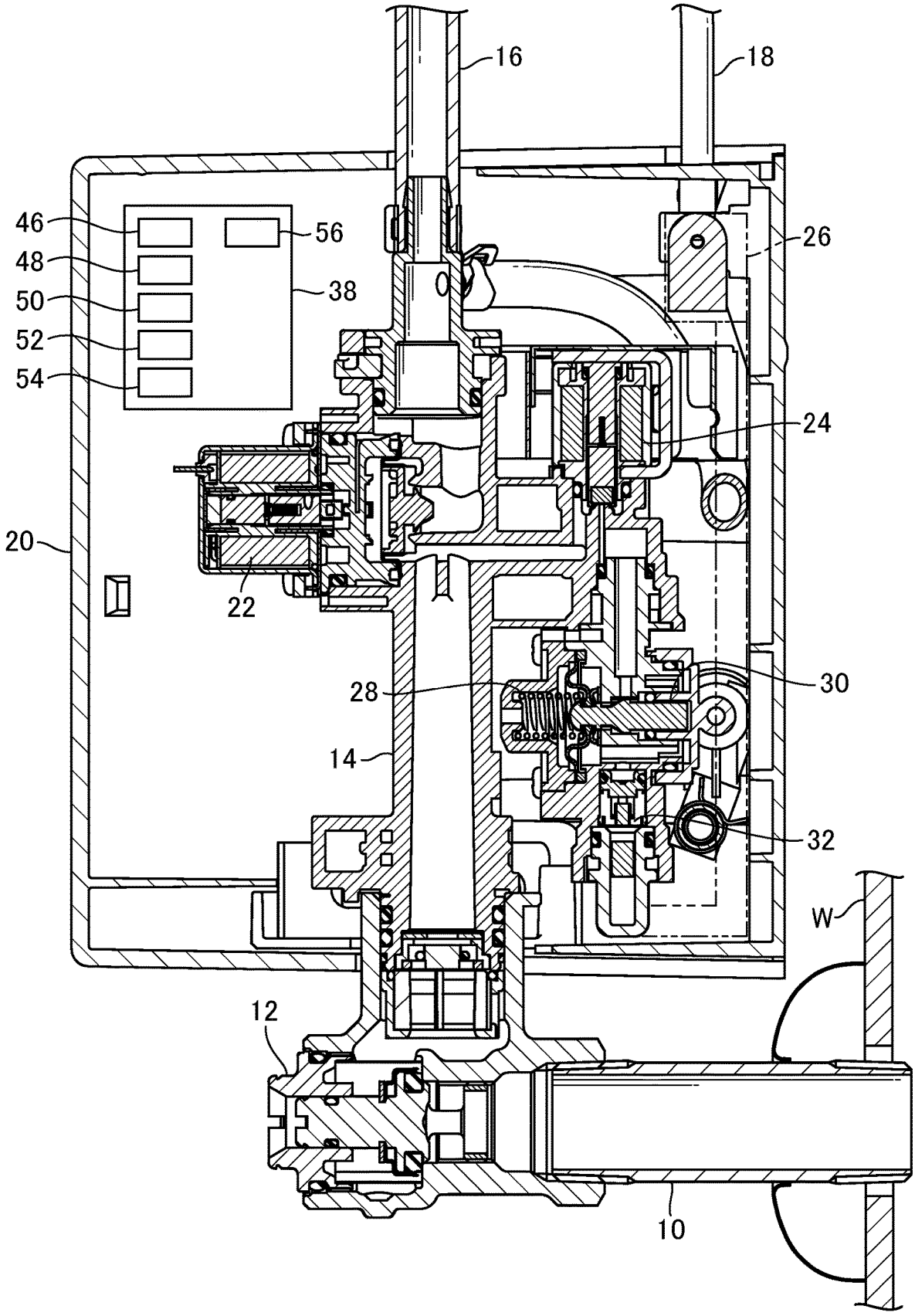
FIG. 5 is a sectional view seen along a V-V line in FIG. 1.

A faucet apparatus according to one embodiment of the present disclosure will be described below with reference to FIGS. 1 to 5. FIG. 1 is a side view of the faucet apparatus according to the one embodiment of the present disclosure that is seen from forward; FIG. 2 is a perspective view of the faucet apparatus according to the one embodiment of the present disclosure; FIG. 3 is a sectional view seen along a line in FIG. 1; FIG. 4 is a sectional view seen along a IV-IV line in FIG. 1; and FIG. 5 is a sectional view seen along a V-V line in FIG. 1. As shown in FIG. 1, a faucet apparatus 1 according to the one embodiment of the present disclosure is a faucet apparatus that spouts supplied tap water into a bowl 2, which is a water receiver, and the faucet apparatus 1 is provided on a counter D that is on the outer side of the bowl 2 of a wash stand apparatus. The faucet apparatus 1 is not limited to what spouts water into the bowl 2 of a wash stand apparatus but may be provided so as to spout water into a sink of a kitchen apparatus or a hand washer of a toilet apparatus as a water receiver, or a bowl and the like that receive spouted water, for other purposes. Further, though the faucet apparatus 1 is formed standing on the counter D, the faucet apparatus 1 is not limited to what is provided on the counter D. The faucet apparatus 1 may be provided on a vertical wall surface, or may be provided horizontally protruding from a wall surface and then protruding downward like a faucet apparatus of a bathroom. For example, the faucet apparatus 1 may be formed such that a spouting unit 4 extends horizontally or obliquely downward from a vertical wall surface. Further, the faucet apparatus 1 is not limited to what is provided standing on the counter D alone. The faucet apparatus 1 may be provided together with other equipment, and a tap water spouting portion and a function water spouting portion may be provided close to each other as described later.

Note that, though the faucet apparatus 1 is configured to spout tap water, which is supplied water, into the bowl 2, the faucet apparatus 1 may further have a function of spouting warm tap water in a warmed state, a function of spouting warm water the temperature of which has been adjusted by mixing warm water and tap water, and the like. The term "tap water" used in the present embodiment may be warm water obtained by adding hot water to supplied tap water or may be warm water obtained by warming supplied tap water. The tap water refers to water supplied mainly from a water conduit, irrespective of the temperature of the water. The "tap water" means water supplied to a faucet apparatus from a water supply facility such as a water conduit and is not required to be water including particular ingredients, which has been processed for drinking at a tap water facility or the like. Among waters as liquids, any water that includes chloride ions (normal natural water includes chloride ions) is possible.

The faucet apparatus 1 comprises a spouting unit 4 installed standing on the counter D. The spouting unit 4 comprises a tap water spouting portion 6 that causes tap water to be spouted into the bowl 2, and a function water spouting portion 8 that causes function water having a greater bacteria removing effect than tap water to be spouted into the bowl 2.

The tap water spouting portion 6 is a spouting unit for tap water provided on the distal end side of the spouting unit 4. The tap water spouting portion 6 is provided to spout supplied tap water into the bowl 2. The tap water spouting portion 6 is arranged being oriented to the front of the bowl 2. The tap water spouting portion 6 is arranged being oriented forward along a transversal line in the front-rear direction of the bowl 2. The tap water spouting portion 6 is formed to spout tap water mainly toward a first water spouting area B (see FIG. 3) in the air above the bowl 2, on the more forward side and lower side of the tap water spouting portion 6. The first water spouting area B is formed mainly as an area along a belt-shaped mainstream from the tap water spouting portion 6 toward the forward side and the lower side but can be also defined as an area that spreads in a conical shape from the tap water spouting portion 6 toward the forward side and the lower side. The cross section of the flow path of the spouting part of the tap water spouting portion 6 is formed larger than the cross section of the flow path of the spouting part of the function water spouting portion 8. Therefore, the flow rate per unit time of tap water spouted from the tap water spouting portion 6 is larger than the flow rate per unit time of function water spouted from the function water spouting portion 8.

The function water spouting portion 8 is a spouting unit for function water provided on the distal end side of the spouting unit 4. The function water spouting portion 8 is provided to spout supplied function water into the bowl 2. The function water spouting portion 8 is arranged being oriented to the front of the bowl 2. The function water spouting portion 8 is arranged being oriented toward a little lower side than the tap water spouting portion 6. The function water spouting portion 8 is arranged being oriented forward along the transversal line in the front-rear direction of the bowl 2. The function water spouting portion 8 is formed to spout function water such that the function water spreads, toward a second water spouting area C in the air above the bowl 2 on the more forward side and lower side of the function water spouting portion 8. The second water spouting area C is also defined mainly as an area that spreads in a conical shape toward the forward side and the lower side from the function water spouting portion 8. The second water spouting area C is set to slightly overlap with the first water spouting area B, and the second water spouting area C is set on a little lower side than the first water spouting area B. The function water spouting portion 8 is formed so that a drain port part of the bowl 2 is located within an extended area of the second water spouting area C. The function water spouting portion 8 is formed to spout function water into a main detection range A of a detection sensor 34. Note that the tap water spouting portion 6 and the function water spouting portion 8 may be formed as a common spouting unit. In this case, the spouting part sides of a first supply flow path 16 and a second supply flow path 18 leading to the common spouting unit are formed as a common flow path, and flow paths on the solenoid valve side are formed to supply tap water and function water separately. The tap water spouting portion 6 and the function water spouting portion 8 form a common unit for spouting provided inside the same spouting unit 4. Since the tap water spouting portion 6 and the function water spouting portion 8 are accommodated in the common spouting unit 4, a sophisticated external appearance can be formed in comparison with the case where there are a plurality of spouting units.

The function water is liquid having an antibacterial effect function of suppressing proliferation of bacteria/viruses or a bacteria removing effect function of reducing bacteria/viruses. It is possible to cause the antibacterial effect function or the bacteria removing effect function to work on parts that spouted function water touches. Such function water has a stronger antibacterial effect or bacteria removing effect than tap water. Therefore, the antibacterial effect function or the bacteria removing effect function is strengthened more than tap water. For example, the function water has a function of the antibacterial effect of suppressing proliferation of bacteria/viruses adhering to the drain port part of the bowl 2 and the like or an object such as a toothbrush and a glass or a function of the bacteria removing effect of reducing the bacteria/viruses. Such bacteria removing effect function of the function water can be used for disinfection to eliminate bacteria/viruses, sterilization to extinguish bacteria/viruses and the like. Therefore, the function water is only required to have a function of any of the "antibacterial effect", "bacteria removing effect", "disinfection effect" and "sterilization effect". The function water is, for example, water that includes hypochlorous acid (for example, hypochlorite water) but may be water that includes ozone (for example, ozone water), electrolyzed water with a strong alkalinity or the like. As the water that includes hypochlorous acid, which is assumed to be function water, tap water may be included.

The water that includes hypochlorous acid, which is function water, is obtained, for example, as electrolyzed water obtained by electrolyzing chloride ions of tap water. Since the water that includes hypochlorous acid returns to original water with passage of time, the water is relatively difficult to influence the environment and can be used as relatively safe water. Thus, it is preferable that the function water is obtained by improving the quality of tap water. Note that the function water can be obtained by a quality improvement method other than electrolysis, for example, a method of adding liquid or gas or performing controlled release of chemicals. Note that the function water can be also obtained as electrolyzed water with a high concentration, by performing electrolysis after adding chemicals or the like. Further, in addition to a method of providing an electrolytic cell on a path communicating with tap water of a water conduit or the like and supplying function water from the electrolytic cell to a function water spouting portion, a method of storing function water prepared by a method other than quality improvement of tap water in a tank and sending the function water from the tank by a pump to supply the function water to a function water spouting portion may be adopted.

As shown in FIG. 5, the faucet apparatus 1 is further provided with a water supply channel 14 connected to a water supply pipe 10 that supplies water from a water supply source (not shown) such as a water conduit, via a stop cock 12, a first supply flow path 16 that branches from the water supply channel 14 and extends, the first supply flow path 16 forming a supply flow path of tap water to the tap water spouting portion 6, and a second supply flow path 18 that branches from the water supply channel 14 and extends, the second supply flow path 18 forming a supply flow path of function water to the function water spouting portion 8.

The water supply pipe 10 communicates with the water supply source (not shown) such as a water conduit, and extends from a structural framework of a building, such as a wall W, into a room where the faucet apparatus 1 is arranged. The water supply pipe 10 comprises the stop cock 12 so that water is stopped between the water supply pipe 10 and the faucet apparatus 1.

The water supply channel 14 is connected to the stop cock 12 and forms a tap water supply channel. The water supply channel 14 is arranged to pass through a case 20 located above the stop cock 12. The case 20 is formed to cover connection portions between the water supply channel 14 and each of the first supply flow path 16, the second supply flow path 18 and the like, and a first solenoid valve 22, a second solenoid valve 24 and the like to be described later.

The first supply flow path 16 branches from the water supply channel 14, extends and communicates with the water supply channel 14 in the case 20. The first supply flow path 16 extends from inside the case 20 toward above the case 20, further extends from below the counter D toward above the counter D, passes through the inside of the spouting unit 4 and is connected to the tap water spouting portion 6.

The second supply flow path 18 branches from the water supply channel 14, extends and communicates with the water supply channel 14. The second supply flow path 18 extends from inside the case 20 toward above the case 20, further extends from below the counter D toward above the counter D, passes through the inside of the spouting unit 4 and is connected to the function water spouting portion 8.

The faucet apparatus 1 is further provided with the first solenoid valve 22 that switches between an opened state and a closed state of the first supply flow path 16, the second solenoid valve 24 that switches between an opened state and a closed state of the second supply flow path 18, and an electrolyzer 26 provided on the second supply flow path 18. Furthermore, on the second supply flow path 18, a pressure adjustment valve 28 capable of adjusting pressure, a safety valve 30 that relieves pressure that is above a predetermined pressure and a check valve 32 that suppresses backflow are provided between the second solenoid valve 24 and the electrolyzer 26.

The first solenoid valve 22 is attached in the first supply flow path 16. The first solenoid valve 22 forms an on-off valve that is electrically driven. The first solenoid valve 22 is electrically connected to a controller 38. The first solenoid valve 22 opens or closes the flow path based on a control signal sent from the controller 38.

The second solenoid valve 24 is attached in the second supply flow path 18. The second solenoid valve 24 forms an on-off valve that is electrically driven. The second solenoid valve 24 is electrically connected to the controller 38. The second solenoid valve 24 opens or closes the flow path based on a control signal sent from the controller 38.

The electrolyzer 26 is a device that generates water including hypochlorous acid by electrolyzing chloride ions included in tap water. The electrolyzer 26 is provided on the second supply flow path 18. The electrolyzer 26 is arranged in the case 20. The electrolyzer 26 is capable of storing tap water supplied from the second supply flow path 18 and capable of supplying electrolyzed water to the more downstream side. The electrolyzer 26 may electrolyze water at any time when necessary and supply the water including hypochlorous acid to the downstream side. The electrolyzer 26 is electrically connected to the controller 38 and performs electrolysis based on a control signal sent from the controller 38.

The faucet apparatus 1 is further provided with the detection sensor 34 that detects an object, an operation portion 36 that accepts an operation instruction by a user, the controller 38 that controls the first solenoid valve 22 and the second solenoid valve 24. The first solenoid valve 22, the second solenoid valve 24 and the controller 38 are arranged in the case 20. The case 20 is arranged below the counter D and above the stop cock 12.

The detection sensor 34 is an infrared sensor that detects existence of an object on the front side (the forward side) of the tap water spouting portion 6, for example, an object such as a toothbrush or a glass, or human hand fingers. The detection sensor 34 is arranged in the spouting unit 4. The detection sensor 34 is arranged at a position near the tap water spouting portion 6 and above the tap water spouting portion 6. The detection sensor 34 is arranged being oriented in the same direction as the tap water spouting portion 6. The detection sensor 34 is arranged so that a main water spouting direction of the tap water spouting portion 6 is included in its main detection range A. The main detection range A of the detection sensor 34 is set mainly as an area where it is easy to detect existence of an object. For example, as shown in FIG. 3, the main detection range A is set to include a front side part in the bowl 2, in a forward and downward direction of the detection sensor 34. The main detection range A is formed, for example, so as to spread in a conical shape from the detection sensor 34. The detection sensor 34 is electrically connected to the controller 38.

The operation portion 36 forms a push-button type operation switch that is push-down operated by the user. Specifically, the operation portion 36 is adapted to be capable of accepting an operation instruction by the user, by the user performing a push-down operation, to judge whether there is a switch operation instruction or not. When receiving an operation instruction by the user in a state of not having an operation instruction yet, the operation portion 36 assumes that it has accepted an operation instruction to cause a second spouting mode 48 to be executed and transmits it to the controller 38. The operation portion 36 has a switch function of causing the second spouting mode 48 to be forcedly executed. Though the operation portion 36 is a contact-type operation switch, it may be a non-contact type operation switch. The operation portion 36 may be a non-contact type operation switch for an infrared sensor, a capacitive type non-contact sensor, a microwave sensor, an ultrasonic sensor or the like. By receiving an operation instruction, the operation portion 36 can be caused to be into a state of existence of an operation instruction to start or stop spouting of function water. For example, when the user presses down the operation portion 36 first to give an operation instruction, the operation portion 36 can be into a state of existence of an operation instruction to cause spouting of function water to be started; and, when the user subsequently presses down the operation portion 36 to give an operation instruction, the operation portion 36 can be into a state of existence of an operation instruction to cause spouting of function water to be stopped.

The controller 38 is electrically connected to the operation portion 36, the detection sensor 34, the first solenoid valve 22, the second solenoid valve 24, the electrolyzer 26 and the like. All or a part of the electrical connections for these may be made by infrared communication or wireless communication by other methods. The controller 38 receives an operation instruction signal from the operation portion 36 by an operation by the user on the operation portion 36. The controller 38 includes an arithmetic unit such as a CPU and a storage device such as a memory and is capable of controlling the electrically connected equipment based on a predetermined control program and the like. For example, the controller 38 stores a control program for executing a first spouting mode 46, the second spouting mode 48, a third water spouting mode 50, a third water spouting mode omission function 52, a second spouting mode prioritization function 54, a second spouting mode end function 56 and the like in the storage device.

The controller 38 comprises the first spouting mode 46 of, when it is judged that the detection sensor 34 has detected an object, causing the first solenoid valve 22 to be in the opened state to cause tap water to be spouted from the tap water spouting portion 6, and the second spouting mode 48 of, by the operation portion 36 accepting an operation instruction, continuing the opened state of the second solenoid valve 24 for a first predetermined time from the opened state which the second solenoid valve 24 become and causing function water to be spouted from the function water spouting portion 8.

The controller 38 is further provided with the third water spouting mode 50 of, after judging that the detection sensor 34 does not detect an object any more after judging that the detection sensor 34 detects the object, causing function water to be spouted from the function water spouting portion 8 for a second predetermined time. The controller 38 is further provided with the third water spouting mode omission function 52, performing control not to execute the third water spouting mode 50 before returning to a waiting state after the second spouting mode 48 has been executed even after the detection sensor 34 changes from the detection state to the non-detection state.

The controller 38 is further provided with the second spouting mode prioritization function 54 of, while the second spouting mode 48 is executed, performing control not to execute the first spouting mode 46 (to defer or omit the execution) and continuing the execution of the second spouting mode 48 even if it is judged that the detection sensor 34 has detected an object, for example, until execution of the second spouting mode 48 ends after the execution is started.

The controller 38 is further provided with the second spouting mode end function 56 of, when a third predetermined time longer than the first predetermined time passes from starting the second spouting mode 48, causing extension of execution of the second spouting mode 48 to be ended even if the controller 38 continues the judgment that the detection sensor 34 has detected an object.

Next, an operation of the faucet apparatus according to the one embodiment of the present disclosure will be described with reference to FIGS. 6 to 10. FIG. 6 is a flowchart showing a water spouting operation of the faucet apparatus according to the one embodiment of the present disclosure, and "S" indicates each step in FIG. 6. In FIGS. 7 to 10, whether the detection sensor 34 is in the detection state or the non-detection state, whether the operation portion 36 is caused to be into a state in which an operation instruction exists or not, whether the first solenoid valve 22 is in the opened or the closed state and whether the second solenoid valve 24 is in the opened or the closed state are shown relative to passage of time indicated by a horizontal axis.

First, as shown in FIG. 6, at step 50, the faucet apparatus 1 is in the waiting state in which spouting from the tap water spouting portion 6 and the function water spouting portion 8 is not performed. In the waiting state, the controller 38 is in a state of repeating a judgment route of steps 50, S1, S7 and S13. At this time, the first solenoid valve 22 for supplying tap water to the tap water spouting portion 6 is in the closed state. The second solenoid valve 24 for supplying function water to the function water spouting portion 8 is in the closed state. The detection sensor 34 is in the non-detection state of not having detected existence of an object. The operation portion 36 is in an operation instruction non-existence state (an off state) of not having accepted an operation instruction by the user.

Next, at step S1, the controller 38 judges whether the detection sensor 34 detects an object or not. If the detection sensor 34 detects an object, the controller 38 can judge that the user's hand fingers and the like, or an object such as a toothbrush or a glass exists in the main detection range A of the detection sensor 34, and that the detection sensor 34 is in a state of detecting the object, and the controller 38 proceeds to step S2 so that predetermined water spouting corresponding to the situation can be performed. If the detection sensor 34 does not detect an object (is in the non-detection state), the controller 38 can judge that the user's hand fingers and the like, or an object such as a toothbrush or a glass does not exist in the main detection range A of the detection sensor 34, and the controller 38 proceeds to step S7.

At step S2, the controller 38 judges whether the operation portion 36 has been into the operation instruction existence state in response to an operation instruction by the user or not. If the operation portion 36 has not received an operation instruction by the user and is in the operation instruction non-existence state, the controller 38 can judge that spouting of function water from the function water spouting portion 8 is not requested, and the controller 38 proceeds to step S3. If the operation portion 36 has received an operation instruction by the user and is in the operation instruction existence state, the controller 38 can judge that spouting of function water from the function water spouting portion 8 is requested, and the controller 38 proceeds to step S8.

At step S3, the controller 38 causes the first spouting mode 46 to be executed to switch the first solenoid valve 22 from the closed state to the opened state and cause tap water to be spouted from the tap water spouting portion 6. After that, the controller 38 proceeds to step S4.

Figure 7:
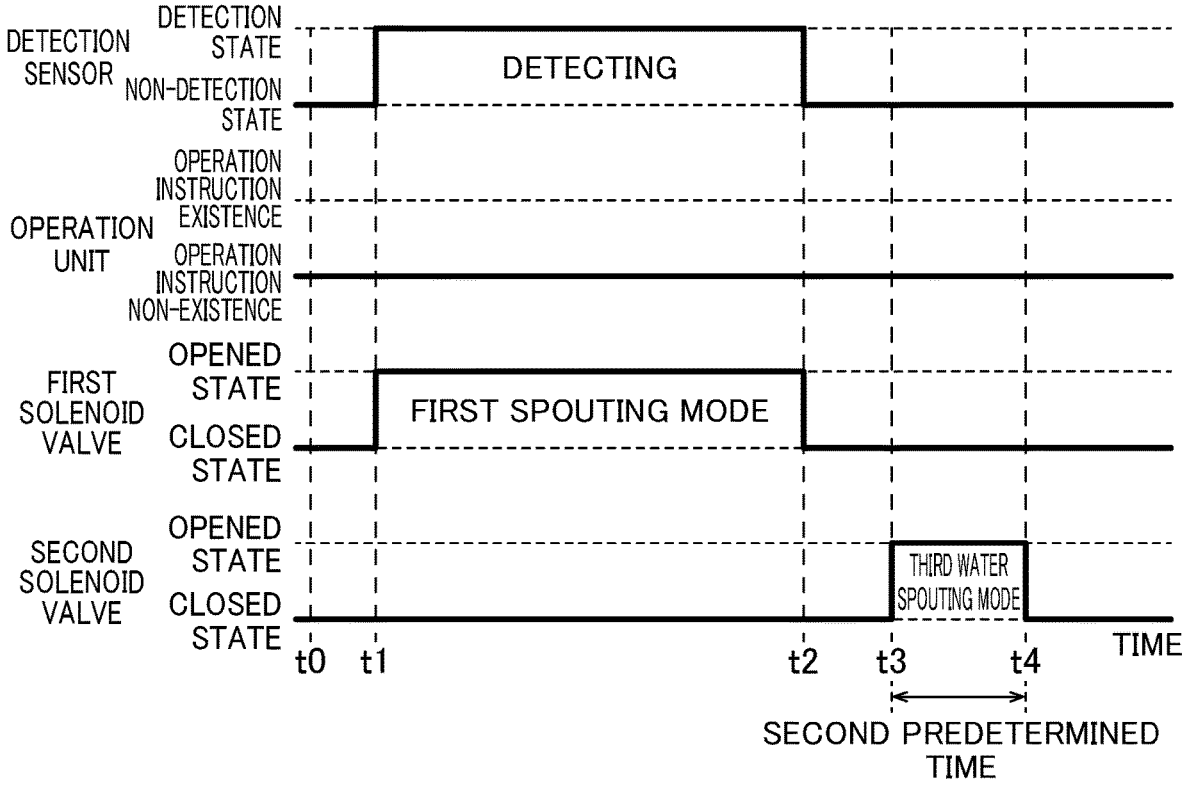
FIG. 7 is a time chart showing operations of a detection sensor, an operation portion, a first solenoid valve and a second solenoid valve in a first water spouting mode of the faucet apparatus according to the one embodiment of the present disclosure.

As shown in FIG. 7, the first spouting mode 46 will be described in more detail. In the waiting state (time t0 to t1), the detection sensor 34 is in the non-detection state; the operation portion 36 is in the operation instruction non-existence state; the first solenoid valve 22 is in the closed state; and the second solenoid valve 24 is in the closed state. At time t1, since the detection sensor 34 changes from the non-detection state to the detection state, and the operation portion 36 is in the operation instruction non-existence state, execution of the first spouting mode 46 is started. The controller 38 switches the first solenoid valve 22 from the closed state to the opened state to cause tap water to be spouted from the tap water spouting portion 6. A spouting flow of the tap water from the tap water spouting portion 6 is formed mainly within the main detection range A of the detection sensor 34. Therefore, the user who is going to cause tap water to be spouted from the tap water spouting portion 6 causes tap water to be spouted from the tap water spouting portion 6 by extending an object such as hand fingers into the main detection range A to cause the detection sensor 34 to detect the object. Therefore, until time t2, spouting of tap water from the tap water spouting portion 6 is continued while the detection sensor 34 continues the detection state. Therefore, it is possible to continue spouting of tap water from the tap water spouting portion 6 to wash the object as long as the user needs. During this time, the second solenoid valve 24 is in the closed state.

At step S4 in FIG. 6, the controller 38 judges whether the detection sensor 34 detects an object or not. If the detection sensor 34 has detected an object, the controller 38 can judge that the user's hand fingers and the like, or an object such as a toothbrush or a glass exists in the main detection range A of the detection sensor 34, and that spouting of tap water is requested. Therefore, the controller 38 returns to step S3 so that execution of the first spouting mode 46 is continued. If the detection sensor 34 has not detected an object (is in the non-detection state), the controller 38 can judge that the state in which an object or the like exists in the main detection range A of the detection sensor 34 has changed to the state in which the object or the like does not exist in the main detection range A of the detection sensor 34 anymore, and that the request for spouting of tap water has ended. Therefore, the controller 38 proceeds to step S5 to end execution of the first spouting mode 46. When the detection sensor 34 changes from the detection state to the non-detection state as shown at step S4 described above at time t2 in FIG. 7, execution of the first spouting mode 46 is caused to be ended (step S5).

At step S5, the controller 38 switches the first solenoid valve 22 from the opened state to the closed state to cause spouting of tap water from the tap water spouting portion 6 to be ended and cause execution of the first spouting mode 46 to be ended, and proceeds to step S6. At time t2 in FIG. 7, the controller 38 switches the first solenoid valve 22 from the opened state to the closed state to cause spouting of tap water from the tap water spouting portion 6 to stop and cause execution of the first spouting mode 46 to be ended.

At step S6, after a predetermined time passes after judging that the detection sensor 34 does not detect an object any more as described above, the controller 38 causes the third water spouting mode 50 of causing function water to be spouted from the function water spouting portion 8 for the second predetermined time to be executed. More specifically, as shown in FIG. 7, after a predetermined time passes after end of execution of the first spouting mode 46 at step S5, preferably after passage of time within a range of about one to five seconds, and more preferably after passage of time of about three seconds, the controller 38 switches the second solenoid valve 24 from the closed state to the opened state to cause function water to be spouted from the function water spouting portion 8. Then, after keeping the second solenoid valve 24 in the opened state for the second predetermined time, preferably for time within the range of about one to five seconds, and more preferably for about three seconds, the controller 38 switches the second solenoid valve 24 from the opened state to the closed state to cause spouting of function water from the function water spouting portion 8 to be ended, and proceeds to step S13. When proceeding to step S13, the controller 38 ends the series of spouting operations, returns to the waiting state and starts control from step 50 again.

From time t2 to t3 in FIG. 7, the controller 38 causes start of execution of the third water spouting mode 50 to be waited for until a predetermined time passes after the detection sensor 34 changes to the non-detection state. The predetermined time is the time preferably within the range of about one to five seconds described above. At time t3 after the predetermined time passes, the controller 38 switches the second solenoid valve 24 from the closed state to the opened state to cause function water to be spouted from the function water spouting portion 8 and cause execution of the third water spouting mode 50 to be started. At this time, the detection sensor 34 is in the non-detection state; the operation portion 36 is in the operation instruction non-existence state; and the first solenoid valve 22 is in the closed state. At this time, though the detection sensor 34 has not detected an object or the like, it is possible to cause function water to be spouted from the function water spouting portion 8 after spouting of tap water ends so that it is possible to make it easy to remove bacteria from the bowl 2, a drain port of the bowl 2 and the like with the function water. At time t4, after the second predetermined time passes after start of execution of the third water spouting mode 50, the controller 38 switches the second solenoid valve 24 from the opened state to the closed state to cause spouting of function water from the function water spouting portion 8 to be ended and cause execution of the third water spouting mode 50 to be ended. After time t4, the controller 38 causes the second solenoid valve 24 to be into the closed state and returns to the waiting state.

At step S7, the controller 38 judges the state of the operation portion 36 about whether the switch of the operation portion 36 is in the operation instruction existence state or in the operation instruction non-existence state in response to an operation instruction by the user. If the operation portion 36 has not received an operation instruction by the user and is in an operation instruction non-existence state, the controller 38 can judge that spouting of function water from the function water spouting portion 8 is not requested, and the controller 38 proceeds to step S13. If the operation portion 36 has received an operation instruction by the user and is in the operation instruction existence state, the controller 38 can judge that spouting of function water from the function water spouting portion 8 is requested, and the controller 38 proceeds to step S8.

At step S8, the controller 38 causes the second spouting mode 48 to be executed to switch the second solenoid valve 24 from the closed state to the opened state and cause function water to be spouted from the function water spouting portion 8. By causing the second spouting mode 48 to be executed, the controller 38 causes the opened state of the second solenoid valve 24 to be continued for the first predetermined time from the opened state which the second solenoid valve become 24 and causing function water to be spouted from the function water spouting portion 8. The first predetermined time is, for example, time within the range of about three to thirty seconds, more preferably, time of about fourteen seconds or time from when the operation portion 36 is into a state in which an operation instruction to cause spouting of function water to start exists until when the operation portion 36 is caused to be into a state in which an operation instruction to cause the spouting of function water to be stopped exists (time between time t11 and t14), and such time can be set in advance so that the setting is effective. After causing the second spouting mode 48 to be executed, the controller 38 proceeds to step S9.

Figure 8:
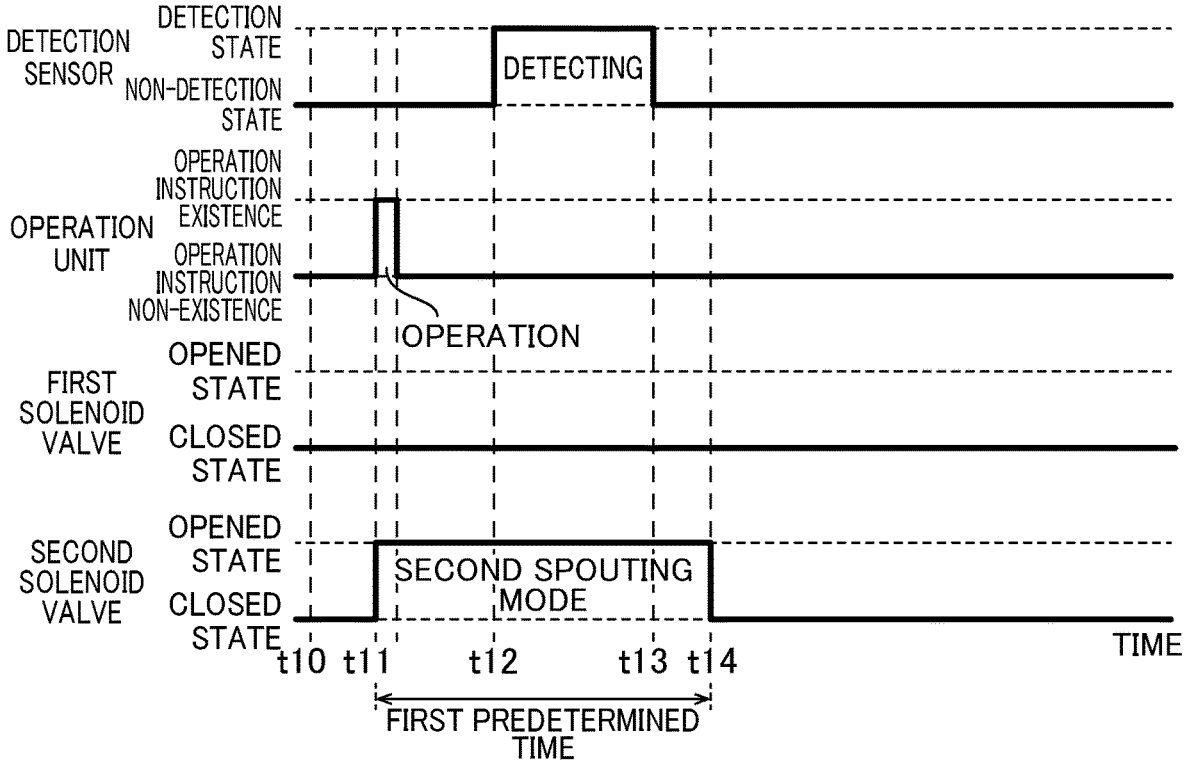
FIG. 8 is a time chart showing operations of the detection sensor, the operation portion, the first solenoid valve and the second solenoid valve of in a second spouting mode of the faucet apparatus according to the one embodiment of the present disclosure.

As shown in FIG. 8, the second spouting mode 48 will be described using a time chart. In the waiting state (time t10 to t11), the detection sensor 34 is in the non-detection state; the operation portion 36 is in the operation instruction non-existence state; the first solenoid valve 22 is in the closed state; and the second solenoid valve 24 is in the closed state. At time t11, when the operation portion 36 is caused to be changed from the operation instruction non-existence state to the operation instruction existence state in response to an operation of a switch or the like at step S2 or S7, the controller 38 switches the second solenoid valve 24 from the closed state to the opened state to cause function water to be spouted from the function water spouting portion 8 and cause execution of the second spouting mode 48 to be started. At this time, the detection sensor 34 is in the non-detection state, and the first solenoid valve 22 remains in the closed state.

At time t12, the detection sensor 34 changes from the non-detection state to the detection state, and, while the second spouting mode 48 is executed, the controller 38 performs control not to execute the first spouting mode 46 even if it is judged that the detection sensor 34 has detected an object, by the second spouting mode prioritization function 54, and continues execution of the second spouting mode 48. Therefore, while the second spouting mode 48 is executed, the controller 38 keeps the first solenoid valve 22 in the closed state without causing it to be into the opened state and leaves the second solenoid valve 24 in the opened state. The operation portion 36 is in the operation instruction non-existence state of not having received an operation instruction.

At time t13, the detection sensor 34 is caused to be into the non-detection state from the detection state before the first predetermined time passes. However, irrespective of the state of detection of the detection sensor 34, execution of the second spouting mode 48 is continued.

Figure 9:
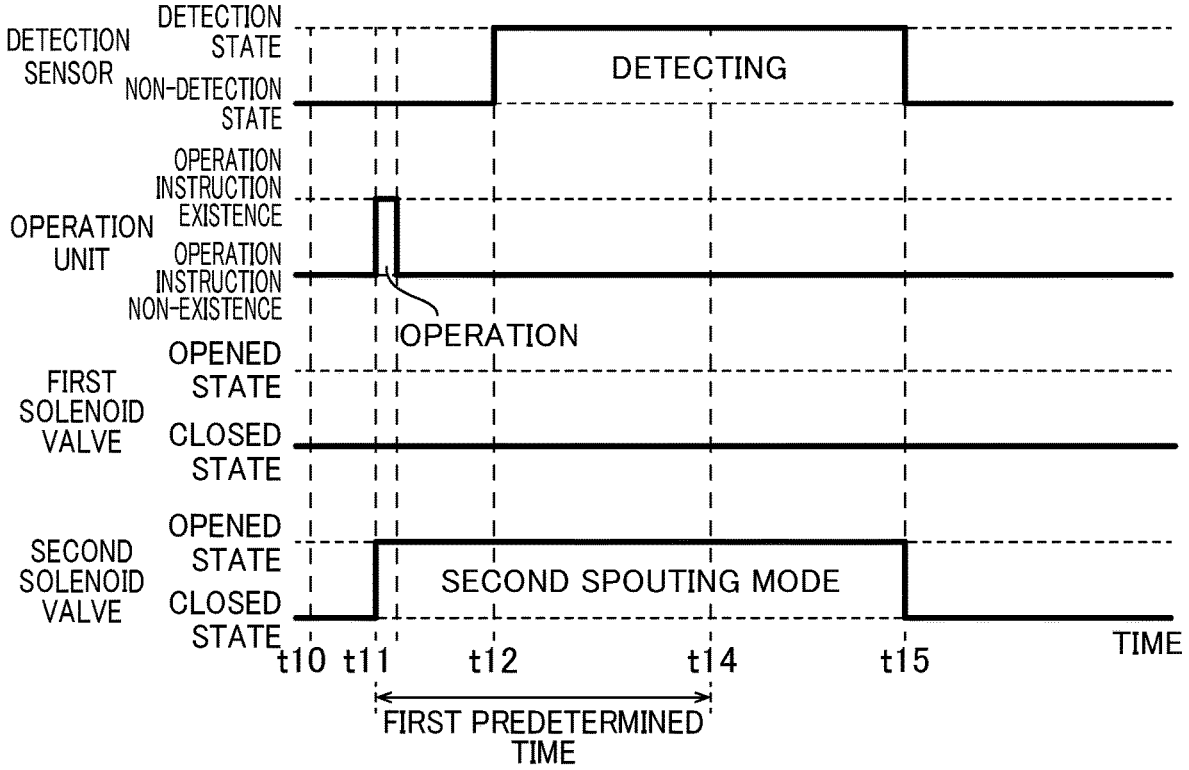
FIG. 9 is a time chart showing operations of the detection sensor, the operation portion, the first solenoid valve and the second solenoid valve related to an operation of extending the second spouting mode of the faucet apparatus according to the one embodiment of the present disclosure.

At step S9, the controller 38 judges whether the detection sensor 34 detects an object or not when the first predetermined time passes. If judging that the detection sensor 34 is continuously in the detection state when the first predetermined time passes, the controller 38 can judge that the user's hand fingers and the like, or an object such as a toothbrush or a glass exists in the main detection range A of the detection sensor 34, and that spouting of function water is still requested, and the controller 38 proceeds to step S10 so as to continue execution of the second spouting mode 48 as shown in FIG. 9. If judging that the detection sensor 34 is in the non-detection state when the first predetermined time passes, the controller 38 can judge that an object or the like does not exist in the main detection range A of the detection sensor 34, and that spouting of function water is not requested any more. Therefore, as shown in FIG. 8, the controller 38 switches the second solenoid valve 24 from the opened state to the closed state to cause spouting of function water from the function water spouting portion 8 to be ended so that execution of the second spouting mode 48 ends in the first predetermined time, and proceeds to step S13.

At time t14 in FIG. 8, if the detection sensor 34 is in the non-detection state, the controller 38 switches the second solenoid valve 24 from the opened state to the closed state to cause spouting of function water from the function water spouting portion 8 to be ended and cause execution of the second spouting mode 48 to be ended when the first predetermined time, time from time t11 to t14, has passed. In this case, the controller 38 proceeds from step S9 to step S13 as described above.

On the other hand, as shown in FIG. 9, there may be a case where, while the second spouting mode 48 is executed, for example, before end of execution of the second spouting mode 48 after start of the execution, the detection sensor 34 is into the detection state, and the detection state continues when the first predetermined time passes. Since the operation from time t10 to t12 in FIG. 9 is the same as the operation from time t10 to t12 in FIG. 8, description thereof will be omitted. When judging that the detection sensor 34 is still in the detection state when the first predetermined time passes at time t14, the controller 38 causes execution of the second spouting mode 48 to be extended as shown at step S10 below.

At step S10, if continuing the judgment that the detection sensor 34 has detected the object when and after the first predetermined time passes, the controller 38 causes the second spouting mode 48 to be extended and executed for more than the first predetermined time and proceeds to step S11. That is, in the extended second spouting mode 48, the controller 38 keeps the second solenoid valve 24 in the opened state and causes time for spouting function water from the function water spouting portion 8 to be further extended.

At time t14 in FIG. 9, if judging that the detection sensor 34 is still in the detection state when the first predetermined time passes, the controller 38 omits the operation of ending the second spouting mode 48 to be performed when the first predetermined time passes and, instead, causes execution of the second spouting mode 48 to be continued even after the first predetermined time passes. After that, the controller 38 also continues keeping the second solenoid valve 24 in the opened state. At this time, the operation portion 36 is in the operation instruction non-existence state, and the first solenoid valve 22 is in the closed state.

From time t14 to t15, the controller 38 judges that the detection sensor 34 is still in the detection state. Therefore, the controller 38 causes the opened state of the second solenoid valve 24 to be extended and causes execution of the second spouting mode 48 to be extended and continued. At time t15, when the detection sensor 34 changes from the detection state to the non-detection state, the controller 38 switches the second solenoid valve 24 from the opened state to the closed state to cause spouting of function water from the function water spouting portion 8 to be ended and cause extension of execution of the second spouting mode 48 to be ended, and proceeds to step S13. In FIG. 9, time between time t14 and t15 indicates extended time.

At step S11, the controller 38 judges whether or not the third predetermined time (time t11 to t16) has passed from starting the second spouting mode 48. The third predetermined time is set longer than the first predetermined time. The third predetermined time is preferably set as time within the range of about thirty seconds to twenty minutes, more preferably, time of about 10 minutes. If judging that the third predetermined time has passed from starting the second spouting mode 48 was started, the controller 38 causes extension of execution of the second spouting mode 48 to be ended by the second spouting mode end function 56 even if still continuing the judgment that the detection sensor 34 has detected the object, and proceeds to step S13. If judging that the third predetermined time longer than the first predetermined time has not passed from starting the second spouting mode 48 was started, it can be judged that the use is within an assumed range for sufficiently removing bacteria from the object with function water, and, therefore, the controller 38 proceeds to step 12 so as to continue extension of execution of the second spouting mode 48.

Figure 10:
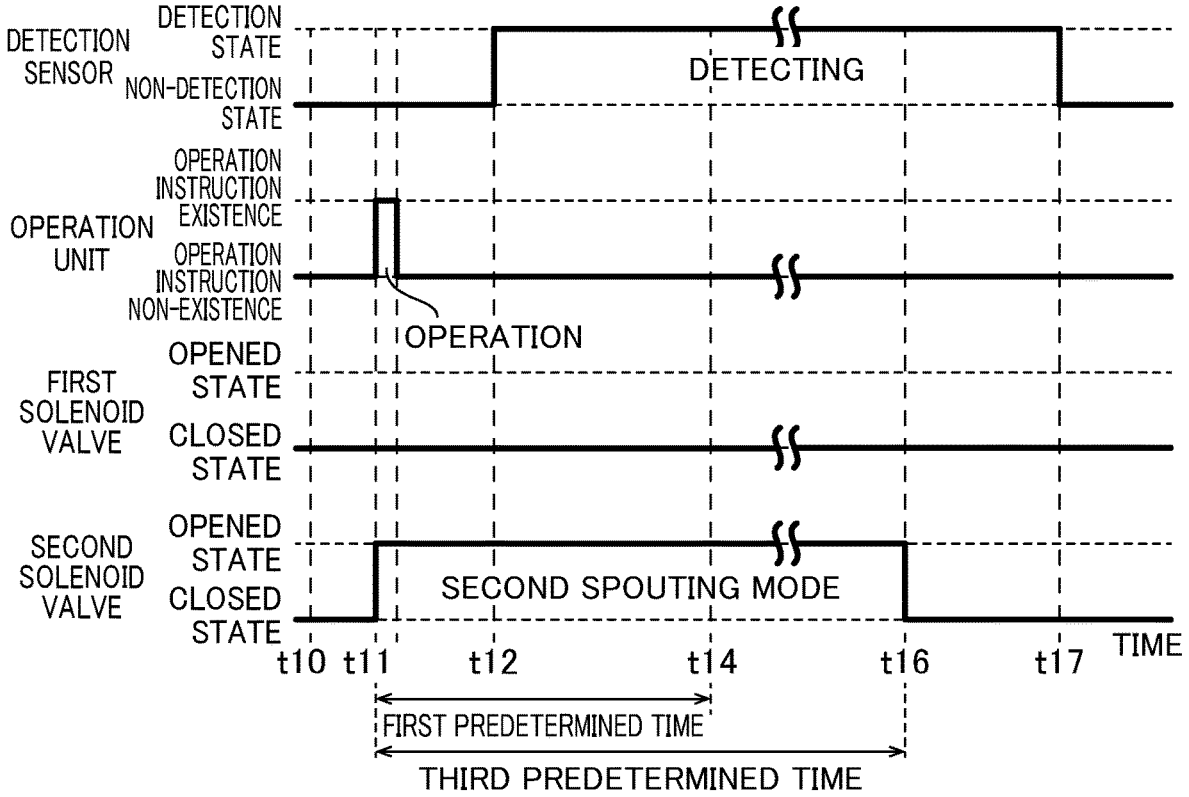
FIG. 10 is a time chart showing operations of the detection sensor, the operation portion, the first solenoid valve and the second solenoid valve related to a function of ending the second spouting mode of the faucet apparatus according to the one embodiment of the present disclosure.

As for the judgment at step S11, description will be made in more detail on a case where the detection sensor 34 is into the detection state while the second spouting mode 48 is executed, and the detection state continues for a relatively long time for some reason as shown in FIG. 10. Since the operation from time t10 to t14 in FIG. 10 is the same as the operation from time t10 to t14 in FIG. 9, description thereof will be omitted. If judging that the detection sensor 34 is still in the detection state even after the first predetermined time passes at time t14, the controller 38 keeps the second solenoid valve 24 in the opened state to cause execution of the second spouting mode 48 to be extended. However, there may be a case where the detection state of the detection sensor 34 continues until time t17 with the detection sensor 34 remaining in the detection state for some reason. For example, if spouting of function water is continued more than necessary when several hours pass from time t10 to t17, there is a possibility that the function water and power are uselessly wasted. Therefore, at time t16 when the third predetermined time passes after the second spouting mode 48 is started, the controller 38 switches the second solenoid valve 24 from the opened state to the closed state to cause spouting of function water from the function water spouting portion 8 to be ended and cause extension of execution of the second spouting mode 48 to be ended by the second spouting mode end function 56 even if the detection sensor 34 continues the detection state. After that, when the detection sensor 34 changes from the detection state to the non-detection state at time t17, the controller 38 proceeds to step S13.

At step S12, the controller 38 judges whether the detection sensor 34 detects an object or not. If the detection sensor 34 has detected an object, the controller 38 can judge that the object or the like still exists in the main detection range A of the detection sensor 34, and that spouting of function water is requested, and the controller 38 returns to step S10 so as to extend and continue execution of the second spouting mode 48. Thereby, in the case of being going to remove bacteria from an object in the main detection range A even after the first predetermined time passes, the removal of bacteria from the object can be continued, and it is possible to cause the bacteria removing effect to easily work on the object. If the detection sensor 34 has not detected an object (is in the non-detection state), the controller 38 can judge that the state in which an object or the like exist in the main detection range A of the detection sensor 34 has changed to a state in which the object or the like does not exist in the main detection range A of the detection sensor 34 anymore, and that the request for spouting of function water has ended. Therefore, the controller 38 switches the second solenoid valve 24 from the opened state to the closed state to cause spouting of function water from the function water spouting portion 8 to be ended so as to cause execution of the extended second spouting mode 48 to be ended, and proceeds to step S13.

At step S13, the controller 38 is into the waiting state in which neither spouting of tap water from the tap water spouting portion 6 nor spouting of function water from the function water spouting portion 8 is performed. At step S13, the controller 38 ends the series of operations, returns to the waiting state and starts control from step 50 again. Note that the controller 38 comprises the third water spouting mode 50 of, after judging that the detection sensor 34 does not detect an object any more after judging that the detection sensor 34 detects the object, causing function water to be spouted from the function water spouting portion 8 for the second predetermined time. After the second spouting mode 48 is executed at step S8, the controller 38 performs control not to execute the third water spouting mode 50 under the control up to step S13 where the controller 38 returns to the waiting state, by the third water spouting mode omission function 52 even after the detection sensor 34 changes from the detection state to the non-detection state.

Further, according to the faucet apparatus 1 according to the one embodiment of the present disclosure, the function water spouting portion 8 is formed to spout function water into the main detection range A of a detection sensor 34; and, the controller 38 comprises the first spouting mode 46, when the detection sensor 34 has detected an object, causing the first solenoid valve 22 to be into the opened state and causing tap water to be spouted from the tap water spouting portion 6 and the second spouting mode 48, by the operation portion 36 accepting an operation instruction, causing the opened state of the second solenoid valve 24 to be continued for the first predetermined time from the opened state which the second solenoid valve 24 become, and causing function water to be spouted from the function water spouting portion 8, the controller 38 further comprises the second spouting mode prioritization function 54 of, while the second spouting mode 48 is executed, controlling not to execute the first spouting mode 46 even if the detection sensor 34 has detected an object. Thereby, even if it is judged that the detection sensor 34 has detected an object while the second spouting mode 48 is executed, spouting of tap water by the first spouting mode 46 is not performed, and the function water spouting portion 8 can spout function water into the main detection range A of the detection sensor 34. Thus, in comparison with a case where tap water is simultaneously spouted together with function water, it is possible to spout only function water to the object detected by the detection sensor 34. Thereby, it is possible to, even when the first spouting mode 46 is adapted to be executed when the detection sensor 34 detects an object, cause function water that has the antibacterial effect or bacteria removing effect to be spouted to a detected object without causing tap water by the first spouting mode 46 to be spouted, so that it is possible to cause the antibacterial effect or bacteria removing effect to effectively work on the object.

Furthermore, according to the faucet apparatus 1 according to the one embodiment of the present disclosure, if the controller 38 judges that the detection sensor 34 has detected an object and, furthermore, continues the judgment that the detection sensor 34 has detected the object after the first predetermined time passes while the second spouting mode is executed, the second spouting mode 48 of the controller 38 is extended and executed for more than the predetermined time while the judgment that the detection sensor 34 has detected the object continues. Thereby, in the case of starting removal of bacteria from an object within the main detection range A of the detection sensor 34 while the second spouting mode 48 is executed, and being going to remove bacteria from the object in the main detection range A even after the predetermined time for the second spouting mode 48 passes, it is possible to extend and execute the second spouting mode 48 for more than the predetermined time, continue the removal of bacterial from the object, continue spouting of function water to the object and cause the bacteria removing effect to work on the object as necessary.

Furthermore, according to the faucet apparatus 1 according to the one embodiment of the present disclosure, the controller 38 includes the third water spouting mode 50, after the detection sensor 34 changes from the detection state of having detected an object to the non-detection state, causing function water to be spouted from the function water spouting portion 8 for the second predetermined time. Thereby, it is possible to cause function water to be spouted from the function water spouting portion 8 after tap water is spouted and make it easy to remove bacteria from the bowl 2, the drain port of the bowl 2 and the like with the function water. The controller 38 is further provided with the third water spouting mode omission function 52, performing control not to execute the third water spouting mode 50 before returning to the waiting state after the second spouting mode 48 has been executed even after the detection sensor 34 changes from the detection state to the non-detection state. Thereby, it is possible to suppress function water from being wastefully spouted by executing the third water spouting mode 50 after executing the second spouting mode 48.

Furthermore, according to the faucet apparatus 1 according to the one embodiment of the present disclosure, when the third predetermined time passes from starting the second spouting mode 48, the controller 38 causes extension of execution of the second spouting mode 48 to be ended by the second spouting mode end function 56 even if the controller 38 continues the judgment that the detection sensor 34 has detected the object. Thereby, even if the controller 38 continues the judgment that the detection sensor 34 has detected an object, the controller 38 can suppress continuance of spouting of function water more than necessary beyond the third predetermined time and suppress function water from being uselessly wasted.

What is claimed is:

1. A faucet apparatus for spouting supplied tap water into a water receiver, the faucet apparatus comprising:

a tap-water spout causing the tap water to be spouted;

a function-water spout causing function water having a higher bacteria removing effect than the supplied tap water to be spouted;

a first solenoid valve switching between an opened state and a closed state of a supply flow path of the tap water to the tap-water spout;

a second solenoid valve switching between an opened state and a closed state of a supply flow path of the function water to the function-water spout;

a controller controlling the first solenoid valve and the second solenoid valve;

a detection sensor detecting an object; and a switch accepting an operation instruction by a user;

wherein the function-water spout is formed to spout the function water into a detection range of the detection sensor;

the controller comprises:

a first spouting mode, which is started when it is judged that the detection sensor has detected an object under a condition wherein both the first solenoid valve and the second solenoid valve have been in the closed states thereof, causing the first solenoid valve to be in the opened state and causing the tap water to be spouted from the tap-water spout until it is judged that the detection sensor has not detected an object; and a second spouting mode, which is started when it is judged that the detection sensor has not detected an object and that the switch has accepted the operation instruction under a condition wherein both the first solenoid valve and the second solenoid valve have been in the closed states thereof, causing the second solenoid valve to be in the opened state and causing the function water to be spouted from the function-water spout for a first predetermined time; and while the second spouting mode is executed after the second spouting mode has been started and thus the second solenoid valve is in the opened state to cause the function water to be spouted from the function-water spout, even if it is judged that the detection sensor has detected an object, the controller is configured to keep the first solenoid valve in the closed state and to leave the second solenoid valve in the opened state.

2. The faucet apparatus according to claim 1, wherein the first predetermined time in the second spouting mode of the controller is set in advance; and if the controller judges that the detection sensor has detected an object and, furthermore, continues the judgment that the detection sensor has detected the object even after the first predetermined time passes while the second spouting mode is executed, the second spouting mode of the controller is extended and executed for more than the first predetermined time while the judgment that the detection sensor has detected the object continues.

3. A faucet apparatus for spouting supplied tap water into a water receiver, the faucet apparatus comprising:

a tap-water spout causing the tap water to be spouted;

a function-water spout causing function water having a higher bacteria removing effect than the supplied tap water to be spouted;

a first solenoid valve switching between an opened state and a closed state of a supply flow path of the tap water to the tap-water spout;

a second solenoid valve switching between an opened state and a closed state of a supply flow path of the function water to the function-water spout;

a controller controlling the first solenoid valve and the second solenoid valve;

a detection sensor detecting an object; and a switch accepting an operation instruction by a user;

wherein the function-water spout is formed to spout the function water into a detection range of the detection sensor;

the controller comprises:

a first spouting mode, when it is judged that the detection sensor has detected an object, causing the first solenoid valve to be in the opened state and causing the tap water to be spouted from the tap-water spout; and a second spouting mode, by the switch accepting the operation instruction, causing the opened state of the second solenoid valve to be continued for a first predetermined time from the opened state causing the function water to be spouted from the function-water spout; and while the second spouting mode is executed and thus the second solenoid valve is in the opened state to cause the function water to be spouted from the function-water spout, even if it is judged that the detection sensor has detected an object, the controller is configured to keep the first solenoid valve in the closed state and to leave the second solenoid valve in the opened state, the controller further comprises a third water spouting mode, after the detection sensor changes from a detection state of having detected an object to a non-detection state, causing the function water to be spouted from the function-water spout for a second predetermined time; and the controller further comprises a third water spouting mode omission function, keeping the second solenoid valve in the closed state before returning to a waiting state after the second spouting mode has been executed even after the detection sensor changes from the detection state to the non-detection state.

4. The faucet apparatus according to claim 2, wherein the controller further comprises a second spouting mode end function, when a third predetermined time longer than the first predetermined time passes from starting the second spouting mode, causing extension of execution of the second spouting mode to be ended even if the controller continues the judgment that the detection sensor has detected the object.

* * * * *